US007748965B2

(12) United States Patent
Schopperle et al.

(10) Patent No.: US 7,748,965 B2
(45) Date of Patent: Jul. 6, 2010

(54) LIVEWELL/BAITWELL PUMP FEATURING ROTATING TRANSOM PICKUP TUBE

(75) Inventors: Jeff B. Schopperle, Wakefield, MA (US); Scott Batchelder, Newbury, MA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 693 days.

(21) Appl. No.: 11/252,979

(22) Filed: Oct. 17, 2005

(65) Prior Publication Data

US 2007/0086903 A1 Apr. 19, 2007

(51) Int. Cl.
*F04B 35/04* (2006.01)

(52) U.S. Cl. ..... 417/423.3; 417/361

(58) Field of Classification Search ..... 417/423.1, 417/423.3, 361; 285/145.1, 145.2, 148.19; 415/126, 127, 128; 248/292.12; 114/183 R, 114/184

See application file for complete search history.

(56) References Cited

U.S. PATENT DOCUMENTS 1,609,915 A 12/1926 Parker
2,219,359 A 10/1940 Le Goit et al.
2,755,055 A * 7/1956 Kreuscher ..... 248/292.12
2,824,520 A 2/1958 Bartels
2,920,574 A 1/1960 Sampietro
2,996,994 A 8/1961 Wright
3,316,845 A 5/1967 Schumann
3,411,450 A 11/1968 Clifton
3,464,358 A 9/1969 Lind
3,465,681 A 9/1969 Zimmermann
3,545,892 A 12/1970 Zimmermann
3,645,547 A * 2/1972 Glover ..... 277/619

(Continued)

FOREIGN PATENT DOCUMENTS

DE 1129055 6/1956

(Continued)

OTHER PUBLICATIONS 7 pages PCT/US1997/11484 International Search Report mailed Nov. 25, 997.

(Continued)

*Primary Examiner*—Devon C Kramer
*Assistant Examiner*—Dnyanesh Kasture

(57) ABSTRACT

A livewell/baitwell pump for installing in a boat or other suitable vessel or apparatus, the pump comprising a pump cartridge assembly having a cartridge body with one or more flexible cantilever snap tabs and with a discharge hose; a pickup tube having an interior cavity with one or more undercuts and with a pickup tube; and each cantilever snap tab of the cartridge body being releasably coupled to a respective undercut of the pickup tube when the cartridge body is inserted into the interior cavity for permitting rotation of the pickup tube and the cartridge body in relation to one another for quickly and easily coupling the discharge hose and the pickup tube in any direction to corresponding hosing or tubing during installation of the pump in the boat or other suitable vessel or apparatus. The pump further comprises an anti-rotation locking ring that permits the rotation of the pickup tube to a desired orientation in relation to the pump cartridge assembly when the anti-rotation locking ring in a first position, and that prevents rotation of the pickup tube once in the desired direction in relation to the pump cartridge assembly when in a second position.

11 Claims, 11 Drawing Sheets

U.S. PATENT DOCUMENTS

| | | | | |
|---|---|---|---|---|
| 3,717,420 | A | 2/1973 | Rachocki | |
| 3,748,066 | A | 7/1973 | Sully et al. | |
| 3,850,550 | A | 11/1974 | Kaessen | |
| 3,861,831 | A | 1/1975 | Rule | 417/423.14 |
| 3,941,507 | A | 3/1976 | Niedermeyer | |
| 4,013,384 | A | 3/1977 | Oikawa | |
| 4,047,847 | A | 9/1977 | Oikawa | |
| 4,081,639 | A | 3/1978 | Tice | |
| 4,171,932 | A | 10/1979 | Miller | |
| 4,186,419 | A | 1/1980 | Sims | |
| 4,213,745 | A | 7/1980 | Roberts | |
| 4,275,995 | A | 6/1981 | Taylor | |
| 4,371,316 | A | 2/1983 | Ivic | |
| 4,441,860 | A | 4/1984 | Tsujimoto | |
| 4,518,316 | A | 5/1985 | Yokota | |
| 4,525,125 | A | 6/1985 | Matsumoto et al. | |
| 4,596,514 | A | 6/1986 | Matsumoto et al. | |
| 4,645,426 | A | 2/1987 | Hartley et al. | |
| 4,678,403 | A | 7/1987 | Rudy et al. | |
| 4,766,329 | A | 8/1988 | Santiago | |
| 4,863,355 | A | 9/1989 | Odagiri et al. | |
| 4,881,873 | A | 11/1989 | Smith et al. | |
| 4,917,135 | A | 4/1990 | Duncan | |
| 4,943,210 | A | 7/1990 | Bailey, Jr. et al. | |
| 4,972,709 | A | 11/1990 | Bailey, Jr. et al. | |
| 5,025,827 | A | 6/1991 | Weng | |
| RE33,690 | E | 9/1991 | Adams, Jr. et al. | |
| 5,064,347 | A | 11/1991 | LaValley, Sr. | |
| 5,076,763 | A | 12/1991 | Anastos et al. | |
| 5,076,890 | A | 12/1991 | Balembois | |
| 5,078,577 | A | 1/1992 | Heckman | |
| 5,091,095 | A | 2/1992 | Fries et al. | |
| 5,092,745 | A | 3/1992 | Graham | |
| 5,100,298 | A | 3/1992 | Shibata et al. | |
| 5,125,247 | A | 6/1992 | Mills | |
| 5,137,064 | A | 8/1992 | McGarvey et al. | |
| 5,139,653 | A | 8/1992 | Ludlam et al. | |
| RE34,111 | E | 10/1992 | Wynn | |
| 5,161,954 | A | 11/1992 | Matheson et al. | |
| 5,181,838 | A | 1/1993 | Sato et al. | 417/360 |
| 5,190,442 | A | 3/1993 | Jorritsma | |
| 5,215,444 | A | 6/1993 | Bishoff | |
| 5,222,867 | A | 6/1993 | Walker, Sr. et al. | |
| 5,225,813 | A | 7/1993 | Raub, Sr. | |
| 5,244,350 | A | 9/1993 | Yang | |
| 5,263,825 | A | 11/1993 | Doolin | |
| 5,282,386 | A | 2/1994 | Niemczyk et al. | |
| 5,289,846 | A | 3/1994 | Elias et al. | |
| 5,293,894 | A | 3/1994 | Fleischmann | |
| 5,297,939 | A | 3/1994 | Orth et al. | |
| 5,322,421 | A | 6/1994 | Hansen | |
| 5,324,170 | A | 6/1994 | Anastos et al. | |
| 5,324,171 | A | 6/1994 | Cook | |
| 5,336,052 | A | 8/1994 | Zollner et al. | |
| 5,340,281 | A | 8/1994 | Su | |
| 5,340,282 | A | 8/1994 | Milocco | |
| 5,352,095 | A | 10/1994 | Tanaka et al. | |
| 5,365,220 | A | 11/1994 | Rasmason | |
| 5,404,048 | A | 4/1995 | Panner | |
| 5,425,624 | A | 6/1995 | Williams | |
| 5,466,127 | A | 11/1995 | Arnswald | |
| 5,493,086 | A | 2/1996 | Murphy, Jr. et al. | |
| 5,519,638 | A | 5/1996 | Tiao | |
| 5,538,406 | A | 7/1996 | Siegal et al. | 417/360 |
| 5,545,012 | A | 8/1996 | Anastos et al. | |
| 5,549,456 | A | 8/1996 | Burrill et al. | |
| 5,586,862 | A | 12/1996 | Danner | |
| 5,624,237 | A | 4/1997 | Prescott et al. | |
| 5,627,522 | A | 5/1997 | Walker et al. | |
| 5,711,652 | A | 1/1998 | Van De Venne et al. | 416/144 |
| 5,833,437 | A | 11/1998 | Kurth et al. | |
| 5,893,589 | A * | 4/1999 | Bleitz et al. | 285/184 |
| 6,045,340 | A | 4/2000 | Batchelder et al. | 417/360 |
| 6,174,142 | B1 | 1/2001 | Holt | 417/363 |
| 6,276,908 | B1 | 8/2001 | Batchelder et al. | 417/423.14 |
| 6,596,939 | B1 * | 7/2003 | Gretz | 174/359 |
| 6,715,994 | B2 | 4/2004 | Patel et al. | 417/12 |
| 6,957,968 | B1 * | 10/2005 | Gretz | 439/92 |
| 6,974,303 | B2 * | 12/2005 | Wang | 415/126 |
| 7,407,371 | B2 * | 8/2008 | Leone et al. | 417/423.15 |
| 2004/0191090 | A1 | 9/2004 | Patel et al. | 417/360 |

FOREIGN PATENT DOCUMENTS

| | | |
|---|---|---|
| DE | 2308369 | 8/1974 |
| DE | 2743112 | 4/1979 |
| DE | 3824847 | 1/1990 |
| DE | 4110488 | 11/1991 |
| DE | 4244417 | 7/1994 |
| EP | 328075 | 8/1989 |
| FR | 955857 | 1/1950 |
| FR | 1204020 | 1/1960 |
| FR | 1535864 | 8/1968 |
| FR | 2086857 | 12/1971 |
| FR | 2410154 | 6/1979 |
| GB | 895256 | 5/1962 |
| GB | 2008873 | 6/1979 |

OTHER PUBLICATIONS

Johnson, T., "Choosing and Installing Bilge pumps," May 2006, Boatkeeper Choosing and Installing Bilge Pumps From Pacific Fishing, Apr. 2001 [http://seagrant.uaf.edu/bookstore/boatkeeper/bilge-pum...] [http://seagrant.uaf.edu].

Kozhevnikov, N. N., "Development and implementation of domestic suction dredges with submersible pumps," Journal of Power Technology and Engineering (formerly Hydrotechnical Construction), vol. 40, No. 6 / Nov. 2006, DOI: 10.1007/s10749-006-0070-0, pp. 325-329. http://www.springerlink.com/content/mhx231n229721820/?p=1ad87eec83244eb288046e3f13135e20&pi=3.

Mihe, J-P., et al., "An inexpensive alternate to level-sensing automatic filling systems for liquid nitrogen," Review of Scientific Instruments, 54, 1421 (1983); DOI:10.1063/ 1.1137238. http://scitation.aip.org/vsearch/servlet/VerityServlet?KEY=FREESR&smode=strresults&sort=chro n&maxdisp=25&threshold=0&possible1=automatic+&possible1zone=article&bool1=and&possible4=filling&possible4zone=article&bool4=and&possible2=pump&possible2zone=article&toyear=1.

Oertling, T. J., "Ships' Bilge Pumps: A History of Their Development, 1500-1900," Studies in Nautical Archaeology: Ships' Bilge Pumps, ISBN 0-89096-722-9, Publication Date: Oct. 1996. Texas A & M University Press.

Pehr, K., et al.,. "Liquid hydrogen for motor vehicles—the world's first public LH2 filling station," International Journal of Hydrogen Energy 26 (2001) 777-782. http://www.ingentaconnect.com/content/els/03603199/2001/00000026/00000007/art00128.

Simonton, W., et al.,. "A programmable micropropagation apparatus using cycled liquid level-sensing technique and medium," Journal of Plant Cell, Tissue and Organ Culture, vol. 27, No. 2/ Nov. 1991. DOI: 10.1007/BF00041292, pp. 211-218. http://www.springerlink.com/content/vn06547821948668/.

Williams, G.J., et al., "An inexpensive automatic device for maintaining the level of liquid nitrogen in cold traps," Journal of Physics E: Scientific Instruments, vol. 6, issue 11, Nov. 1973, pp. 1088-1089. DOI: 10.1088/0022-3735/6/11/010 http://www.iop.org/EJ/abstract/0022-3735/6/11/010.

* cited by examiner

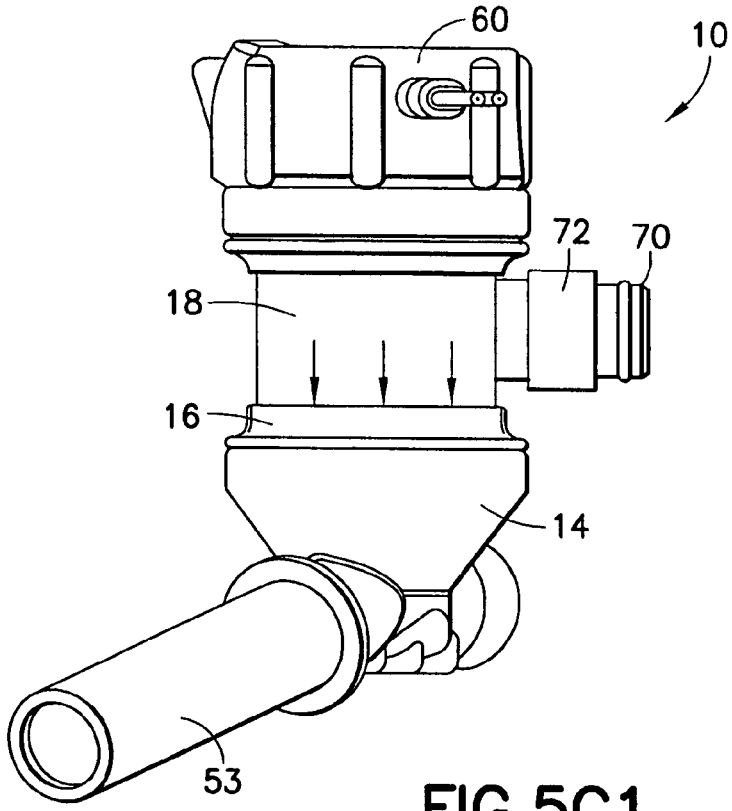
FIG.5C1
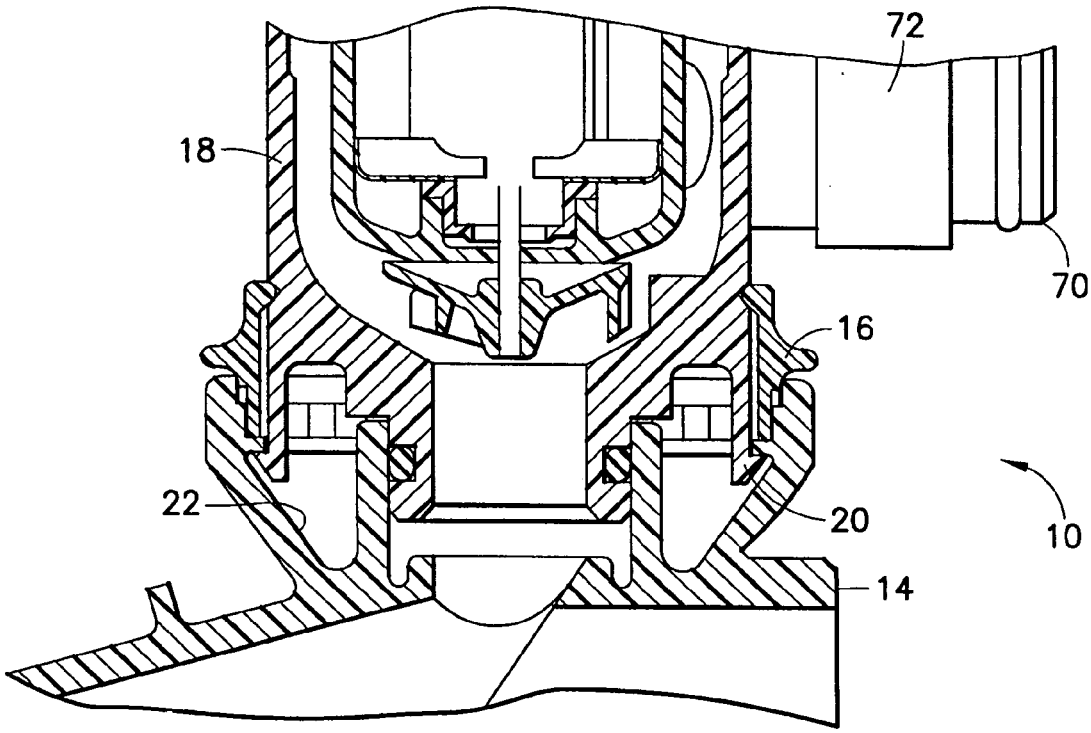
FIG.5C2

LIVEWELL/BAITWELL PUMP FEATURING ROTATING TRANSOM PICKUP TUBE

CROSS-REFERENCE TO RELATED APPLICATION

This application is related to a corresponding application filed on the same day as the present application and identified by a patent application Ser. No. 11/252,974, which is hereby incorporated by reference in its entirety.

BACKGROUND OF THE INVENTION

1. Technical Field

The present invention relates to a pump; and more particularly to a livewell/baitwell pump.

2. Description of Related Art

Livewell/baitwell pumps are known in the art and are typically installed in boats or other suitable fishing vessels to process water in wells or tanks holding fish that are caught or bait used to catch the same. The livewell/baitwell pumps may be located in areas that are not easily accessible, which makes installing or replacing the pumps tricky or difficult.

In particular, one known livewell/baitwell pump has a fixed base that is in one position secured by mounting screws. In order to change the position with the known pump, one must remove the screws and reset the position of the pick up tube. This repositioning is typically done at the manufacturer, which is typically time consuming, expensive, and does not lend itself to a quick or easy installation or replacement process.

In view of this, there is a need in the art for a livewell/baitwell pump that is more quickly and easily install and/or replaced. In particular, there is a need to eliminate the use of such mounting screws, which would reduce manufacturing time and also eliminate the possibility of the mounting screws vibrating loose in the known livewell/baitwell pump.

SUMMARY OF THE INVENTION

The present invention provides a new and unique pump, such as a livewell/baitwell pump, and method for installing the same in a boat or other suitable vessel or apparatus, featuring a pump cartridge assembly for rotatably coupling to a pickup tube. The pump cartridge assembly has a cartridge body with one or more flexible cantilever snap tabs and with a discharge nozzle. The pickup tube has an interior cavity with one or more undercuts and with a pickup tube port. During installation, each cantilever snap tab of the cartridge body is releasably coupled to a respective undercut of the pickup tube when the cartridge body is inserted into the interior cavity for permitting rotation of the pickup tube and the cartridge body in relation to one another for quickly and easily positioning the discharge nozzle and the pickup tube port in any direction to corresponding hosing or tubing during installation of the pump in the boat or other suitable vessel or apparatus. The locking ring cantilever snap tabs eliminate the need for using screws which reduce manufacturing time and eliminate the possibility of screws vibrating loose during the life of the pump.

Moreover, the pump also features an anti-rotation locking ring that is arranged on the cartridge body to slide upwardly and downwardly between the first position and the second position. During installation, the anti-rotation locking ring permits rotation of the pickup tube in the direction in relation to the cartridge body, or vice versa, when the anti-rotation locking ring is in a first position, and prevents rotation of the pickup tube once in the direction in relation to the cartridge body, or vice versa, when the anti-rotation locking ring is in a second position.

In addition, the interior cavity of the pickup tube also has one or more anti-rotation ribs arranged therein, and the anti-rotation locking ring has a surface with one or more corresponding anti-rotation ribs thereon. When the pump is installed, each anti-rotation rib of the pickup tube engages a respective corresponding anti-rotation rib of the anti-rotation locking ring for preventing rotation of the pickup tube once in the direction in relation to the cartridge body when the anti-rotation locking ring is moved to the second position.

The anti-rotation locking ring also includes one or more locking ring cantilever snaps that releasably engage one or more corresponding cantilever snap recesses in the pump cartridge assembly when the anti-rotation locking ring is in either the first position or the second position.

In order to complete the installation, the anti-rotation locking ring is pressed down and locked into the pickup tube in the second position with at least one locking ring cantilever snap releasably engaging at least one corresponding cantilever snap recesses in the pump cartridge assembly.

The present invention also includes a method for installing the pump in a boat or other suitable vessel or apparatus, featuring steps consistent with that described herein.

One advantage of the present invention is that it allows the end user to rotate the pickup tube to any position after installation of the livewell/baitwell pump in the boat or other suitable fishing vessel.

BRIEF DESCRIPTION OF THE DRAWING

FIG. 5C1 shows a side view of a pump with the slide locking ring pressed down and locked in place as indicated by the arrows; and FIG. 5C2 shows a cross-sectional view of the pump in FIG. 5C.

BEST MODE FOR CARRYING OUT THE INVENTION

Figure 1A:
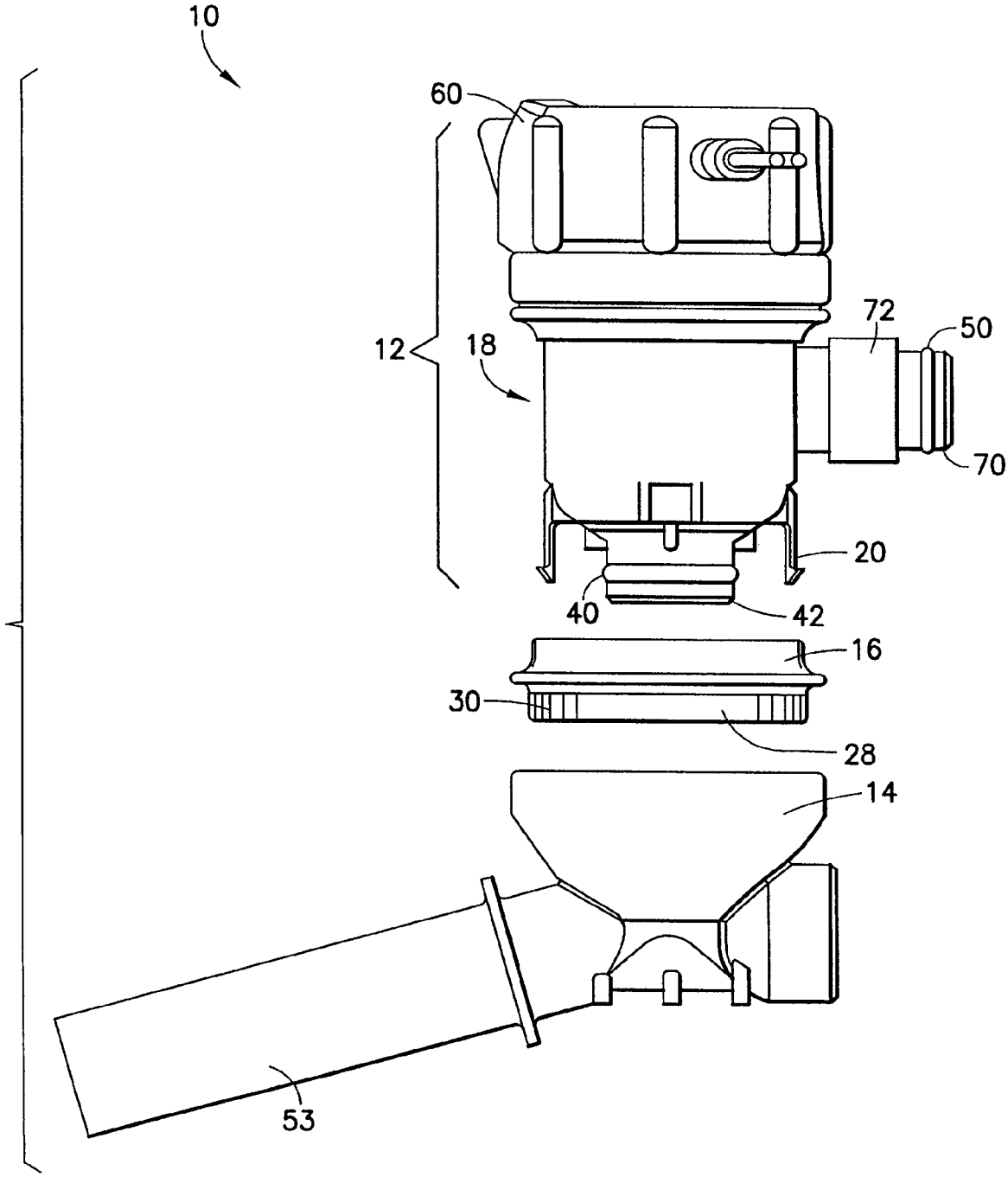
FIG. 1A shows an exploded side view of a pump according to the present invention.
Figure 2:
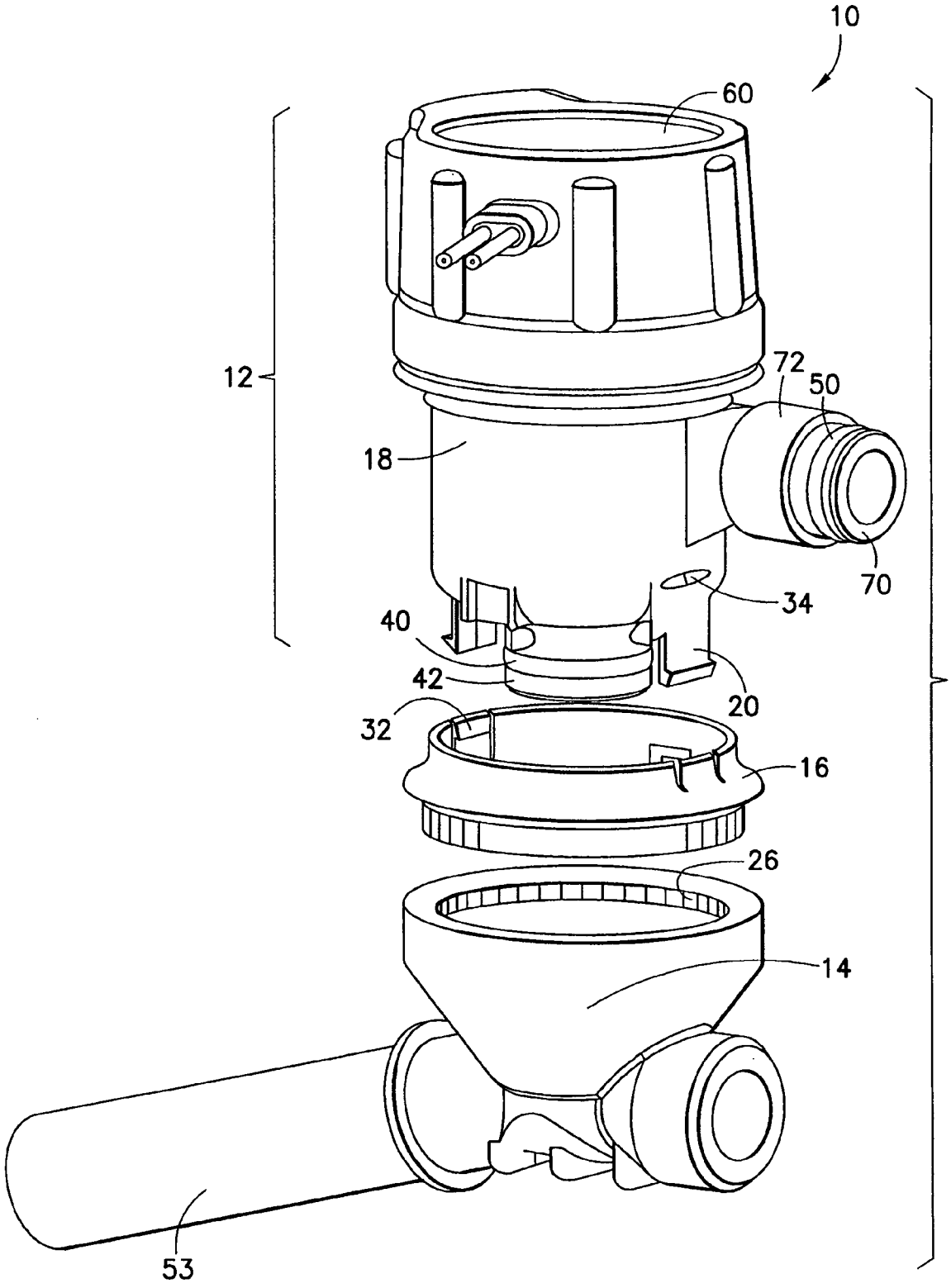
FIG. 2 shows an exploded perspective side view of a pump in a pre-pickup tube assembly state according to the present invention.

FIGS. 1A to 5C2 show a new and unique livewell/baitwell pump generally indicated as 10 having a pump cartridge assembly 12, a pickup tube 14 and an anti-rotation locking ring 16, as well as a method for installing the pump 10 in a boat or other suitable fishing vessel or apparatus (not shown).

Figure 3A:
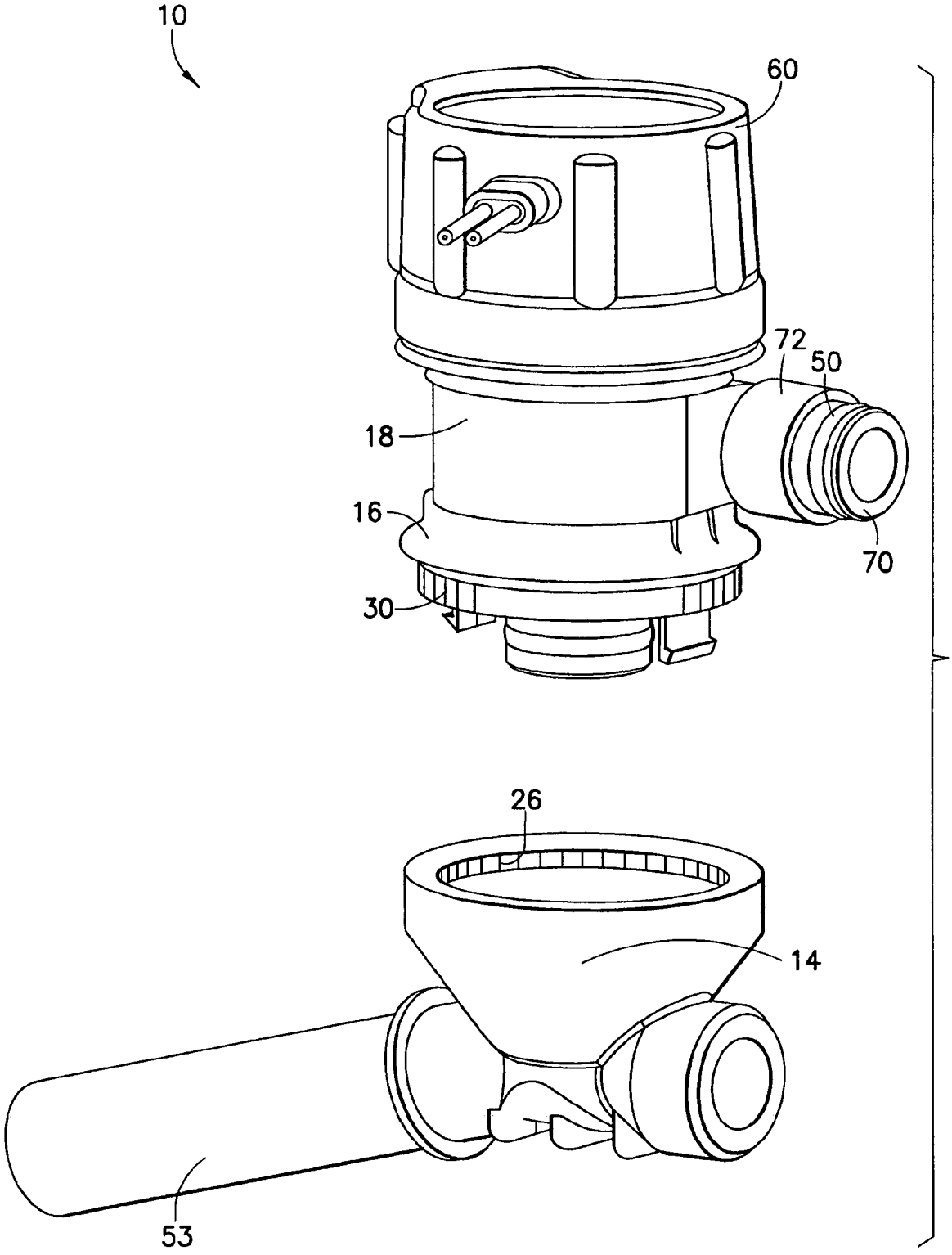
FIG. 3A shows an exploded perspective side view of a pump with the slide locking ring upward over the cantilever snaps according to the present invention.

The pump cartridge assembly 12 includes a body 18 having one or more flexible cantilever snap tabs 20 and a discharge nozzle 70. The pickup tube 14 has an interior cavity 22 with one or more pickup tube undercuts 24 (see FIG. 4B), a pickup tube port 53 and one or more anti-rotation ribs 26 (see FIG. 3A) arranged therein. During installation, each cantilever snap tab 20 of the cartridge body 18 is releasably coupled to a respective undercut 24 of the pickup tube 14 when the cartridge body 18 is inserted into the interior cavity 22 for permitting rotation of the pickup tube 14 and the cartridge body 18 in relation to one another for quickly and easily positioning the discharge nozzle 70 and the pickup tube port 53 in any direction to corresponding hosing or tubing (not shown) during installation of the pump 10 in the boat or other suitable vessel or apparatus (not shown).

Figure 1B:
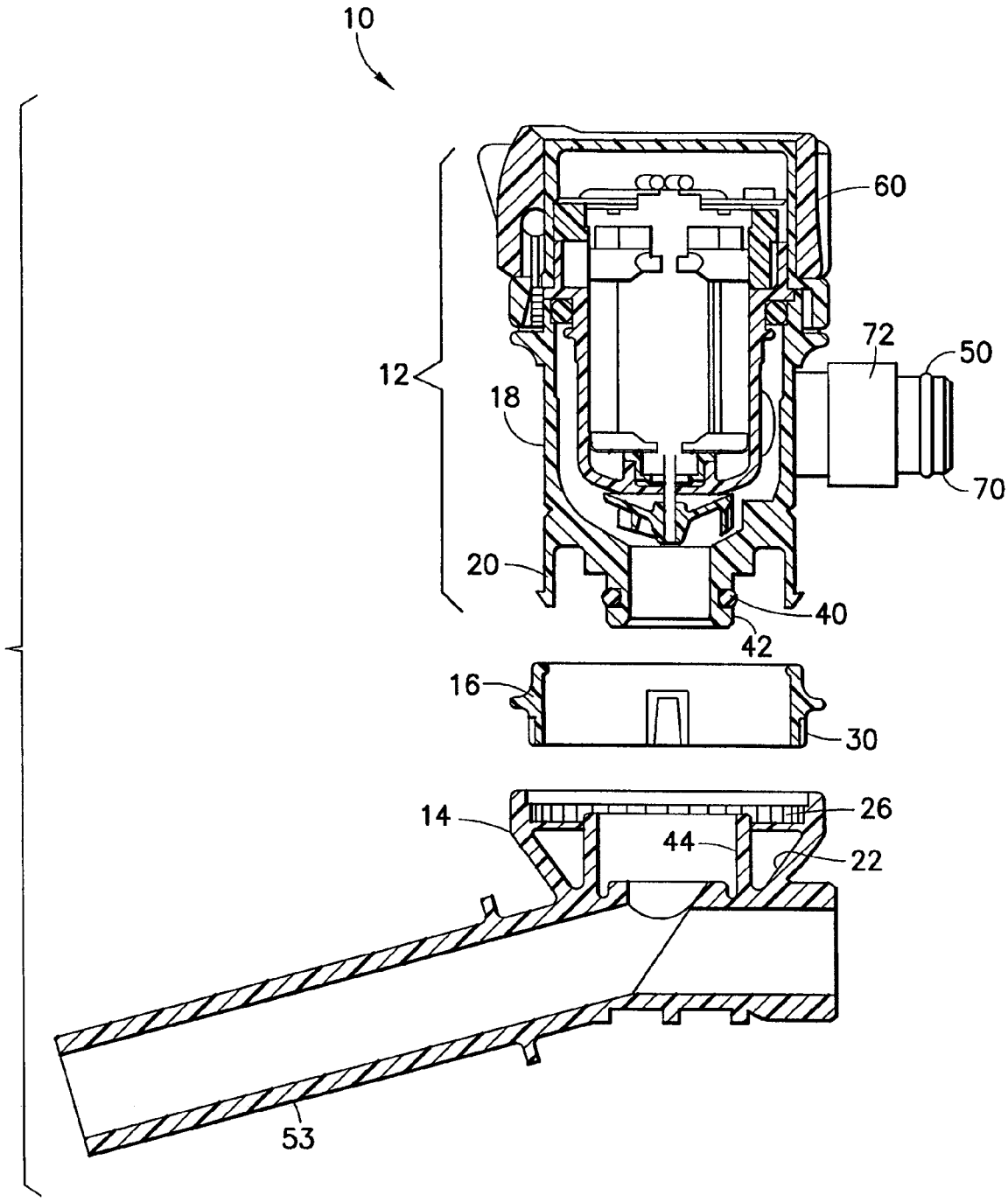
FIG. 1B shows a cross-sectional view of the pump in FIG. 1A.
Figure 3B:
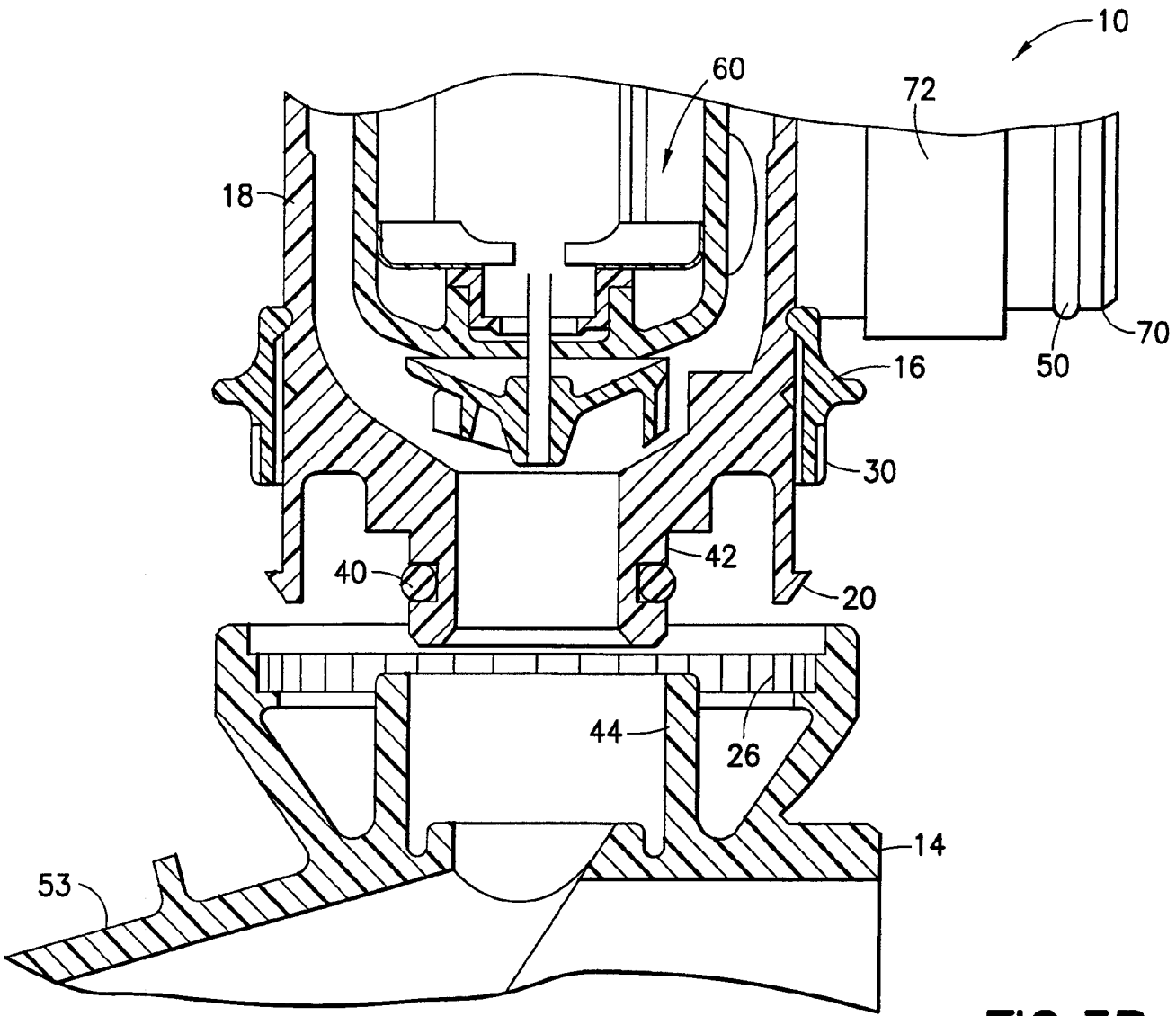
FIG. 3B shows a cross-sectional view of the pump in FIG. 3A.

As shown, the anti-rotation locking ring 16 is slidably arranged in relation to the cartridge body 18 of the pump cartridge assembly 12 and has a surface 28 with one or more corresponding anti-rotation ribs 30 (FIG. 1A) thereon. The anti-rotation locking ring 16 is movable between a first position (see FIGS. 3A and 3B) and a second position (see FIGS. 5C1 and 5C2) in relation to the cartridge body 18.

Figure 4A:
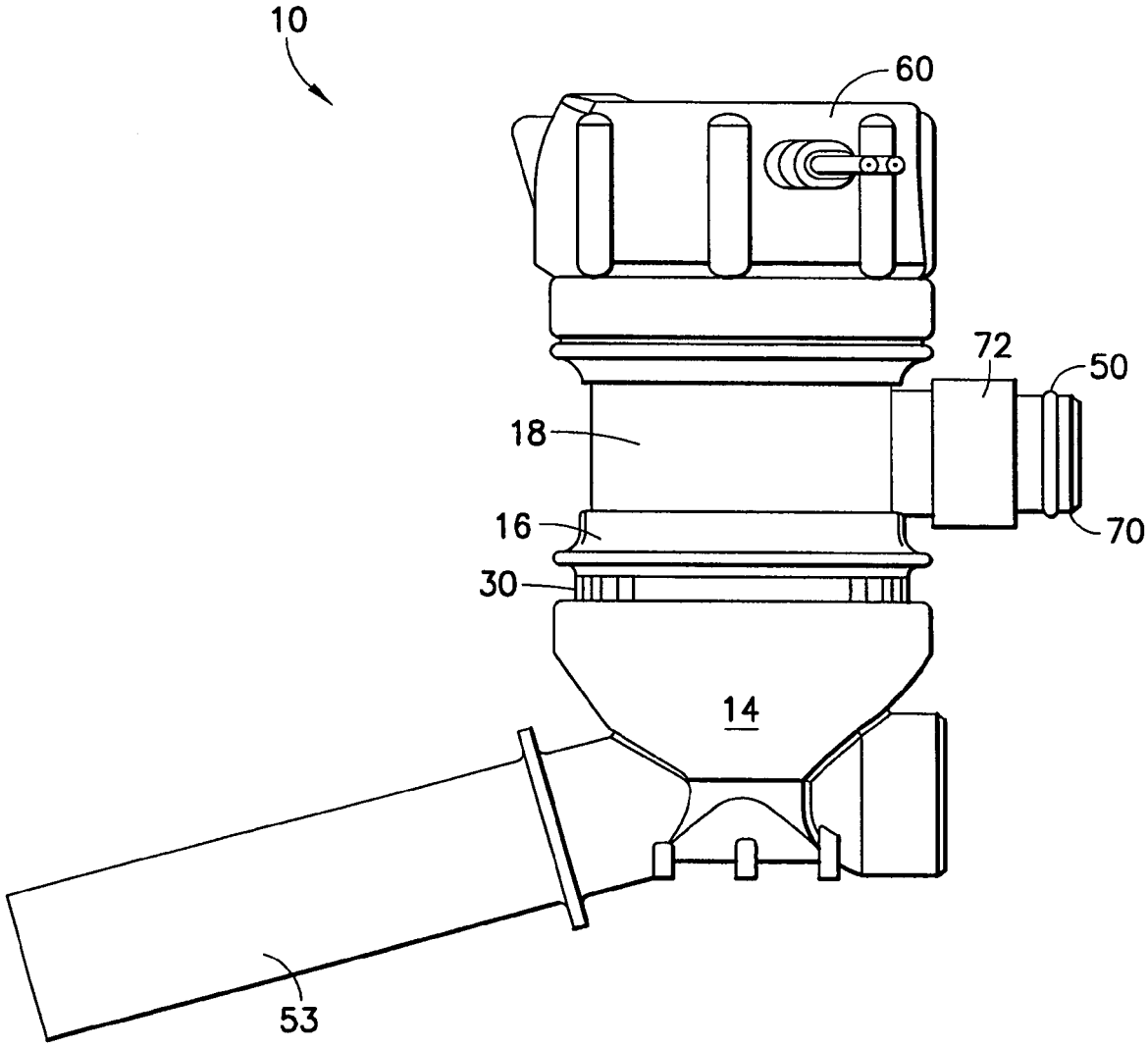
FIG. 4A shows a side view of a pump with the pickup tube coupled to the cartridge assembly according to the present invention.
Figure 4B:
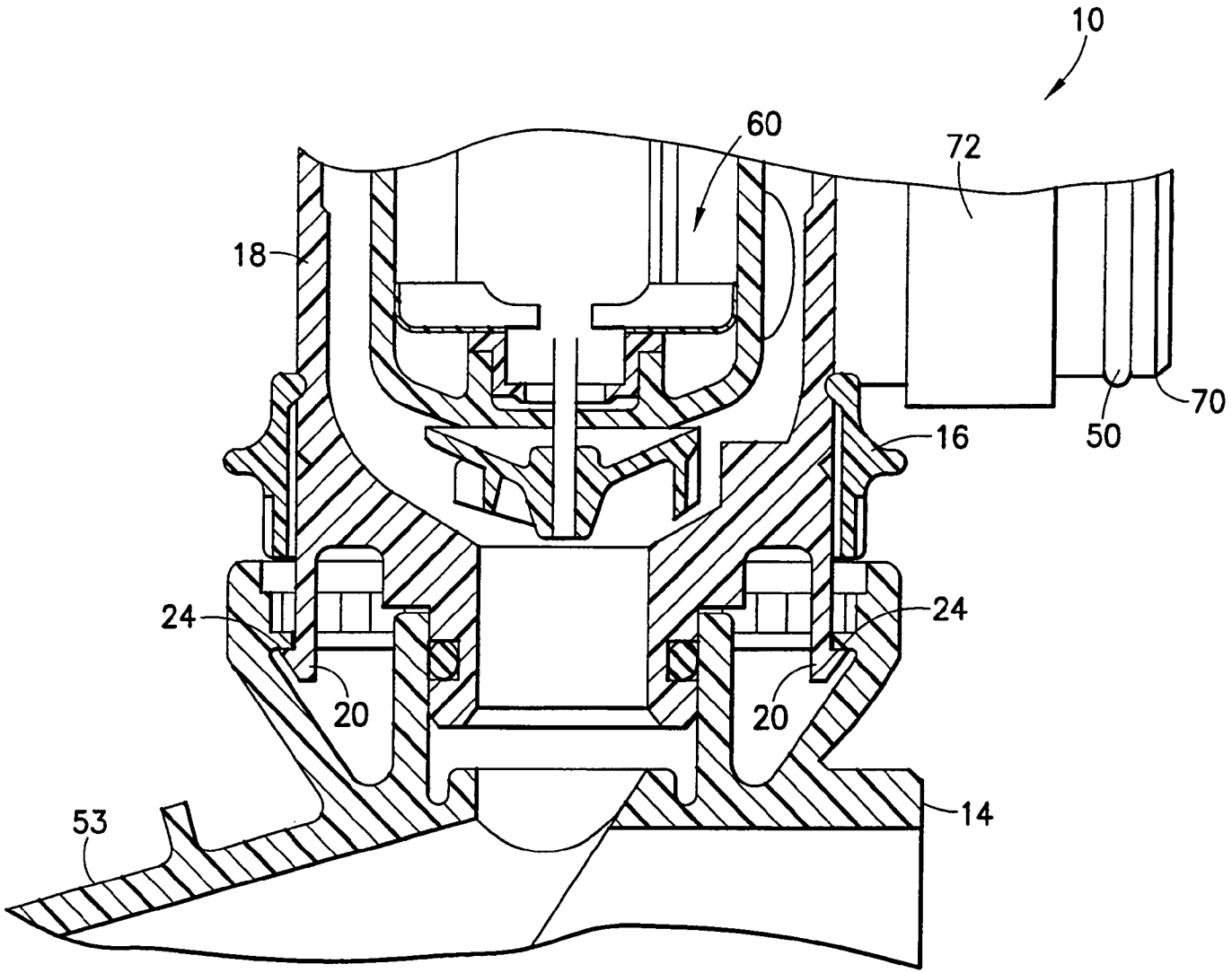
FIG. 4B shows a cross-sectional view of the pump in FIG. 4A.
Figure 5A:
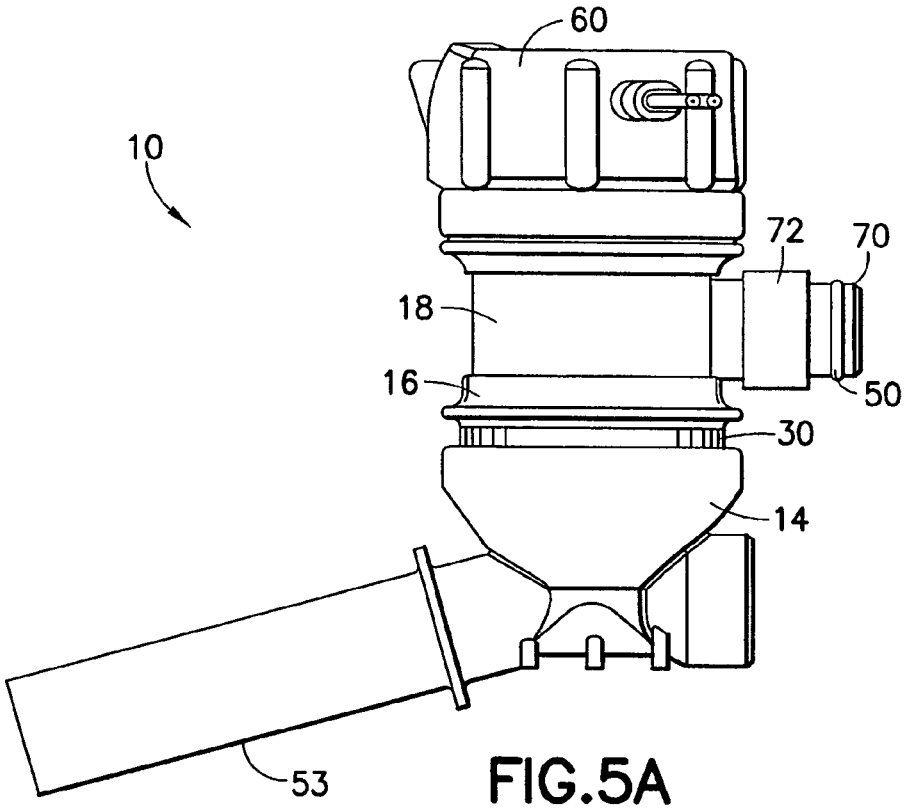
FIG. 5A shows a side view of a pump with the pickup tube coupled to the cartridge assembly as shown in FIG. 4A.
Figure 5B:
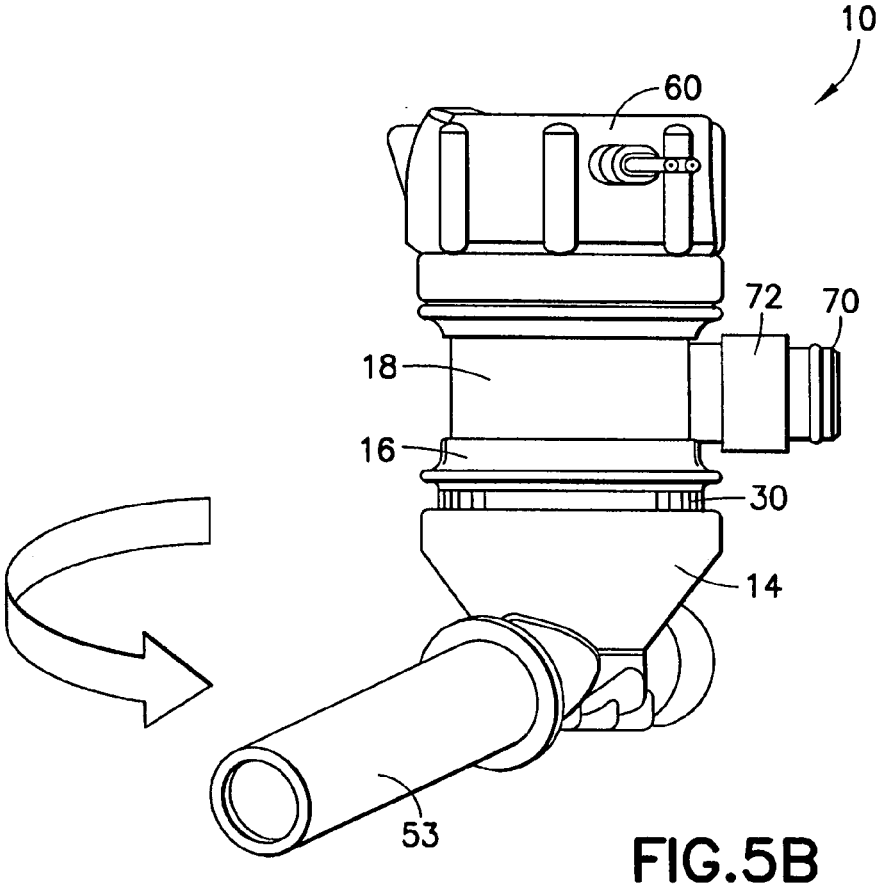
FIG. 5B shows a side view of a pump with the pickup tube rotated as indicated by the arrow to a desired position.

When the pump 10 is installed in the boat or other suitable fishing vessel or apparatus, each cantilever snap tab 20 is releasably coupled to a respective undercut 24 of the pickup tube 14 as best shown in FIGS. 4A and 4B for permitting rotation of the pickup tube 14 to a desired orientation in relation to the cartridge body 18 when the anti-rotation locking ring 16 is in the first position (i.e. "upward"). When the body 18 is pushed into the interior cavity 22, the cantilever snap tabs 20 deflect inwardly, snap into placed and grip the undercuts 24, as shown. Once the pickup tube 14 is rotated in the direction as best shown in FIGS. 5A and 5B, the anti-rotation locking ring 16 is pressed down as best shown in FIGS. 5C1 and 5C2, and each anti-rotation rib 26 of the pickup tube 14 engages a respective corresponding anti-rotation rib 30 of the anti-rotation locking ring 16 for preventing rotation of the pickup tube 14 in relation to the pump cartridge assembly 12 when the anti-rotation locking ring 16 is in the second position (i.e. "downward").

As best shown in FIG. 2, the anti-rotation locking ring 16 also includes one or more locking ring cantilever snaps 32 that releasably engage one or more corresponding cantilever snap recesses 34 in the pump cartridge assembly 12 when the anti-rotation locking ring 16 is in either the first position (FIGS. 4A and 4B) or the second position (FIGS. 5C1 and 5C2).

In comparison, when the pump 10 is uninstalled, the aforementioned assembly process is basically reversed. For example, one manually releases the locking ring cantilever snaps 32 by pulling them outwardly so the anti-rotation locking ring 16 can be lifted upwardly. Then, the cantilever snap tabs 20 are manually deflected inwardly, so the cartridge body 18 can be lifted upwardly out of the interior cavity 22 of the pickup tube 14.

FIGS. 1A to 5C2 also show many other features of the pump 10 that do not form part of the underlying invention, including but not limited to the following elements: an O-rings 40 for sealably coupling a port 42 of the cartridge body 18 to a corresponding port 44 of the pickup tube 14 as best shown in FIGS. 1A and 1B and 3A and 3B; an O-rings 50 for sealably coupling the discharge nozzle 70 of the cartridge body 18 to a corresponding port (not shown) in the boat, as also best shown in FIGS. 1A and 1B and 3A and 3B; a replaceable cartridge 60 that is shown and described in relation to a aforementioned corresponding application identified above by the patent application Ser. No. 11/252,974. During installation, the pickup tube 53 is coupled to the transom (not shown) of the boat (not shown). The discharge nozzle 70 also may include a discharge nozzle coupling connection 72 that allow for multiple connection options.

Figure 6A:
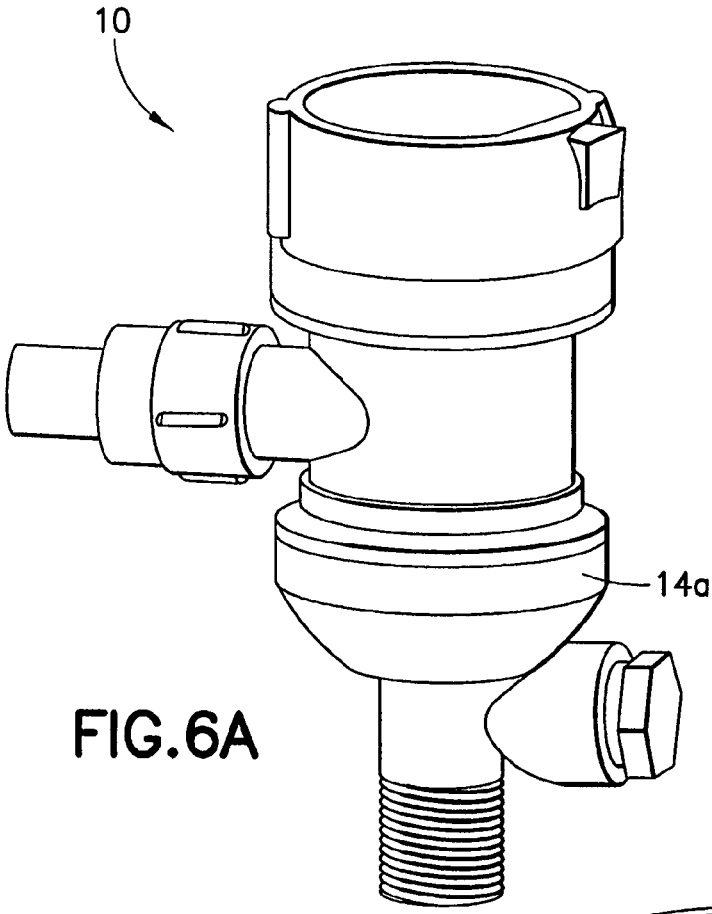
FIGS. 6A, 6B and 6C show three pumps having different pickup tubes.
Figure 6B:
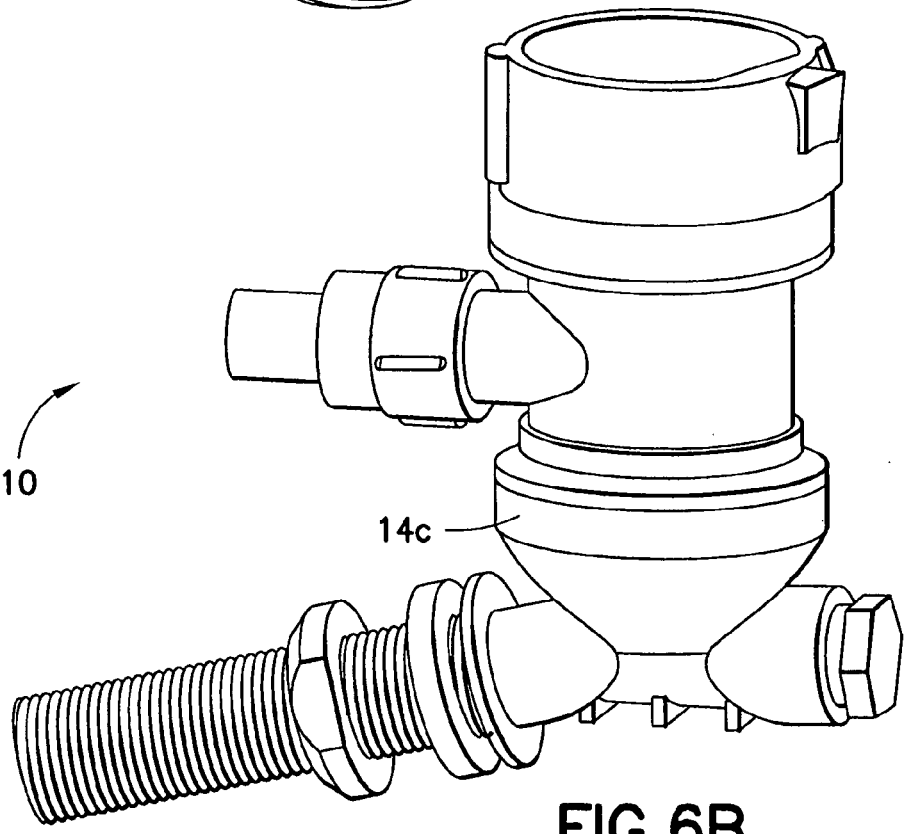
Figure 6C:
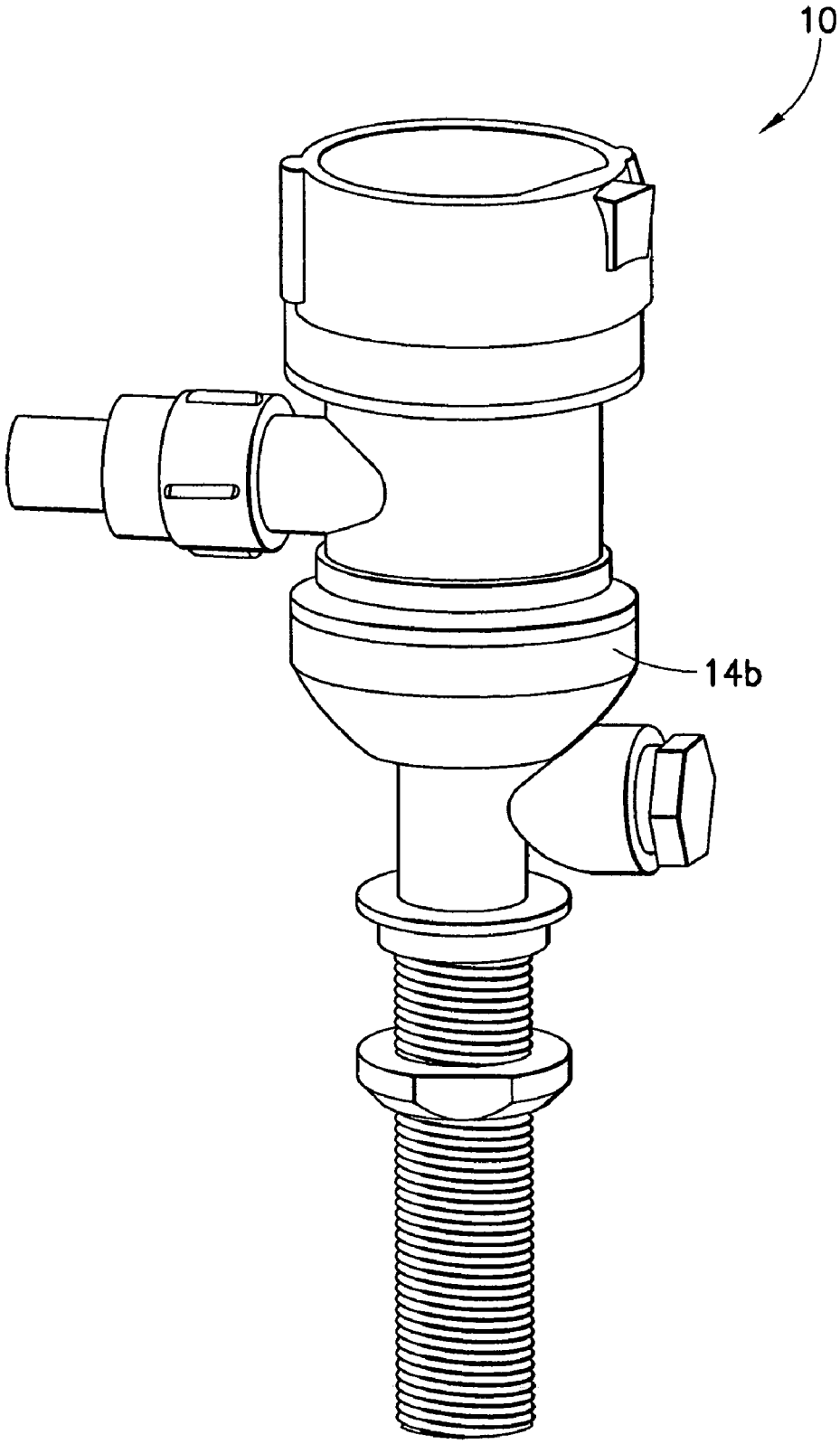

FIGS. 6A, 6B and 6C show three different pumps having three different pickup tubes 14*a*, 14*b*, 14*c*. Embodiments of the invention are envisioned using many different types and kind of pickup tube configurations depending on the dimensional requirements of the boat or other suitable fishing vessel, and the scope of the invention is not intended to be limited to any particular type or kind thereof.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein without departing from the spirit and scope of the present invention.

The invention claimed is:

1. A pump for installing in a boat or other suitable vessel or apparatus, the pump comprising:

a pump cartridge assembly having a cartridge body with one or more flexible cantilever snap tabs and with a discharge nozzle;

a pickup tube having an interior cavity with an undercut, and having a pickup tube port, the interior cavity having an inner cylindrical surface with one or more anti-rotation ribs that are formed on the inner cylindrical surface as projections that protrude radially inwardly;

an anti-rotation locking ring configured to slide on the cartridge body between a locked position and an unlocked position, wherein one or more cantilever snaps on the anti-rotation locking ring releasably engages one or more corresponding recesses in the cartridge body when the anti-rotation locking ring is in the locked position, and wherein said cantilever snaps are disengaged from said corresponding recesses when the anti-rotation locking ring is in the unlocked position, the anti-rotation locking ring having an outer cylindrical surface with one or more corresponding anti-rotation ribs that are formed on the outer cylindrical surface as corresponding projections that protrude radially outwardly;

each flexible cantilever snap tab of the cartridge body configured to snap into place and grip the undercut of the pickup tube when the cartridge body is inserted into the interior cavity and the anti-rotation locking ring is positioned in the unlocked position and which permits rotation of the pickup tube and the cartridge body in relation to one another for positioning the discharge nozzle and the pickup tube port to correspond with hosing or tubing during installation of the pump in the boat or other suitable vessel or apparatus; and the outer cylindrical surface of the anti-rotation locking ring configured to slide at least partly into the interior cavity so that each corresponding anti-rotation rib frictionally engages a respective anti-rotation rib of the pickup tube to prevent a further rotation of the pickup tube in relation to the pump cartridge assembly when the anti-rotation locking ring is positioned in the locked position.

2. A pump according to claim 1, wherein the anti-rotation locking ring is pressed and locked into the pickup tube with at least one locking ring cantilever snap frictionally engaging at least one corresponding cantilever snap recesses in the cartridge body.

3. A pump according to claim 1, wherein the unlocked position allows rotation of the pickup tube in relation to the pump cartridge assembly, and the locked position prevents further rotation of the pickup tube in relation to the pump cartridge assembly.

4. A pump according to claim 1, wherein the pump is a livewell/baitwell pump.

5. A method comprising:

sliding an anti-rotation locking ring on a cartridge body of a pump cartridge assembly into an unlocked position, the anti-rotation locking ring having an outer cylindrical surface with one or more anti-rotation ribs that are formed on the outer cylindrical surface as projections that protrude radially outwardly; and coupling one or more flexible cantilever snap tabs of the cartridge body of the pump cartridge assembly to an undercut of a pickup tube when the cartridge body is inserted into an interior cavity of the pickup tube and the anti-rotation locking ring is in the unlocked position so that the one or more flexible cantilever snap tabs is snapped into place and grips the undercut;

rotating the pickup tube and the cartridge body in relation to one another, once the one or more flexible cantilever snap tabs is coupled to the undercut, for positioning a discharge nozzle of the pump cartridge assembly and a pickup tube port of the pickup tube to correspond with hosing or tubing during installation of the pump in the boat or other suitable vessel or apparatus; and sliding the anti-rotation locking ring into a locked position, where the interior cavity of the pickup tube is configured with an inner cylindrical surface with one or more corresponding respective anti-rotation ribs that are formed on the inner cylindrical surface as corresponding projections that protrude radially inwardly for frictionally engaging the one or more anti-rotation ribs on the outer cylindrical surface of the anti-rotation locking ring when the anti-rotation locking ring is slid at least partly into the interior cavity to prevent a further rotation of the pickup tube in relation to the pump cartridge assembly when the anti-rotation locking ring is in the locked position wherein one or more cantilever snaps on the anti-rotation locking ring releasably engages one or more corresponding recesses in the cartridge body when the anti-rotation locking ring is in the locked position, and wherein said cantilever snaps are disengaged from said corresponding recesses when the anti-rotation locking ring is in the unlocked position.

6. A method according to claim 5, wherein the method comprises pressing and locking the anti-rotation locking ring into the pickup tube.

7. A method according to claim 5, wherein the pump is a livewell/baitwell pump.

8. A livewell/baitwell pump comprising:

a pump cartridge assembly having a cartridge body with one or more flexible cantilever snaps;

a pickup tube having an interior cavity with an undercut and a surface with one or more anti-rotation ribs;

an anti-rotation locking ring configured to slide on the cartridge body between a locked position and an unlocked position, wherein one or more cantilever snaps on the anti-rotation locking ring releasably engages one or more corresponding recesses in the cartridge body when the anti-rotation locking ring is in the locked position, and wherein said cantilever snaps are disengaged from said corresponding recesses when the anti-rotation locking ring is in the unlocked position, and the anti-rotation locking ring having a corresponding surface with one or more corresponding anti-rotation ribs;

each flexible cantilever snap configured to snap into place and grip the undercut of the pickup tube when the cartridge body is inserted into the interior cavity and the anti-rotation locking ring is in the unlocked position and to permit rotation of the pickup tube in any direction in relation to the cartridge body when the anti-rotation locking ring is in the unlocked position; and the anti-rotation locking ring configured to slide into the locked position so that each anti-rotation rib of the pickup tube frictionally engages a respective corresponding anti-rotation rib of the anti-rotation locking ring for preventing a further rotation of the pickup tube in relation to the cartridge body when the anti-rotation locking ring is in the locked position.

9. A livewell/baitwell pump according to claim 8, wherein the one or more locking ring cantilever snaps frictionally engage one or more corresponding cantilever snap recesses in the cartridge body when the anti-rotation locking ring is in the locked position.

10. A livewell/baitwell pump according to claim 8, wherein one or more anti-rotation ribs are formed on an inner cylindrical surface of the pickup tube as projections that protrude radially inwardly; and wherein the one or more corresponding anti-rotation ribs are formed on an outer cylindrical surface of the anti-rotation locking ring as corresponding projections that protrude radially outwardly.

11. A method for installing a pump in a boat or other suitable vessel or apparatus, comprising:

coupling one or more flexible cantilever snap tabs of the cartridge body of the pump cartridge assembly to an undercut of a pickup tube when the cartridge body is inserted into an interior cavity of the pickup tube and the anti-rotation locking ring is in an unlocked position, where the one or more flexible cantilever snap tabs is snapped into place and grips the undercut;

rotating a pickup tube and a pump cartridge assembly in relation to one another for coupling a discharge nozzle of the pump cartridge assembly and a pickup tube port of the pickup tube to correspond with hosing or tubing during installation of the pump in the boat or other suitable vessel or apparatus, the one or more cantilever snap tabs being snapped into place and gripping the undercut so as to allow such a rotation; and sliding the anti-rotation locking ring at least partly into the interior cavity into a locked position so that one or more anti-rotation ribs formed on an outer cylindrical surface of the anti-rotation locking ring as projections that protrude radially outwardly frictionally engages one or more corresponding respective anti-rotation ribs formed on an inner cylindrical surface of the interior cavity as corresponding projections that protrude radially inwardly to prevent a further rotation of the pickup tube in relation to the pump cartridge assembly when the anti-rotation locking ring is in the locked position, wherein one or more cantilever snaps on the anti-rotation locking ring releasably engages one or more corresponding recesses in the cartridge body when the anti-rotation locking ring is in the locked position, and wherein said cantilever snaps are disengaged from said corresponding recesses when the anti-rotation locking ring is in the unlocked position.

* * * * *